US011873156B2

(12) United States Patent
Murray

(10) Patent No.: US 11,873,156 B2
(45) Date of Patent: Jan. 16, 2024

(54) STAND UP OBJECT SHAPED POUCH

(71) Applicant: Pouch Pac Innovations, LLC, Sarasota, FL (US)

(72) Inventor: R Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 27 days.

(21) Appl. No.: 17/109,218

(22) Filed: Dec. 2, 2020

(65) Prior Publication Data

US 2021/0171270 A1 Jun. 10, 2021

Related U.S. Application Data

(60) Provisional application No. 62/943,869, filed on Dec. 5, 2019.

(51) Int. Cl.
*B65D 81/32* (2006.01)
*B65D 25/08* (2006.01)
*B65D 75/00* (2006.01)

(52) U.S. Cl.
CPC ..... *B65D 81/3266* (2013.01); *B65D 25/08* (2013.01); *B65D 75/008* (2013.01)

(58) Field of Classification Search
CPC .. B65D 75/008; B65D 81/3266; B65D 25/08; B65D 75/00
USPC ..... 206/219, 233; 383/210.1, 204, 92, 94, 383/105
See application file for complete search history.

(56) References Cited

U.S. PATENT DOCUMENTS 2,663,298 A * 12/1953 Rose ..... A61M 5/1409 604/408
3,542,032 A * 11/1970 Spencer, Jr. ..... A61F 7/106 62/530
3,911,918 A * 10/1975 Turner ..... A61M 1/029 422/44
4,952,068 A * 8/1990 Flint ..... B01F 25/42 366/162.3
7,175,614 B2 * 2/2007 Gollier ..... A61J 1/2093 206/219
8,616,426 B2 * 12/2013 Carlozzi ..... B65D 77/02 383/88
9,440,779 B1 * 9/2016 Hach ..... B65D 81/3261
2002/0166779 A1 * 11/2002 Etesse ..... B65D 75/566 206/219
2004/0045842 A1 * 3/2004 Matsuda ..... B65D 81/3266 383/906
2005/0087456 A1 * 4/2005 Oka ..... A61J 1/2093 206/219
2008/0083348 A1 * 4/2008 Kuo ..... A61C 9/0026 106/35
2008/0234652 A1 * 9/2008 McCarthy ..... A61B 90/96 604/410
2010/0126888 A1 * 5/2010 Lee ..... A61C 9/0026 206/219

(Continued)

*Primary Examiner* — Rafael A Ortiz
(74) *Attorney, Agent, or Firm* — Fishman Stewart PLLC

(57) ABSTRACT

A flexible pouch for packaging contents has a pair of leg portions having gussets. A bridge connect the leg portions. At least one arm extends upwardly. The pouch can be formed to represent various objects such as letters. The pouches can be formed with compartments for holding different components. The compartments may be separated by frangible seals to permit components to be mixed within the pouch.

14 Claims, 8 Drawing Sheets

(56) References Cited

U.S. PATENT DOCUMENTS

| | | | | |
|---|---|---|---|---|
| 2011/0100844 | A1* | 5/2011 | Cimaglio | C04B 40/065 206/219 |
| 2015/0125097 | A1* | 5/2015 | Kenmotsu | B65D 31/10 383/42 |
| 2015/0158635 | A1* | 6/2015 | Gum | B65D 75/008 383/38 |
| 2017/0208797 | A1* | 7/2017 | Murray | A01N 65/16 |
| 2019/0142694 | A1* | 5/2019 | Di Naro | B65D 75/5883 604/408 |

* cited by examiner

STAND UP OBJECT SHAPED POUCH

CROSS-REFERENCE TO RELATED APPLICATIONS

This application claims the benefit of U.S. Provisional Application 62/943,869 filed on Dec. 5, 2019.

FIELD OF THE INVENTION

A standup flexible pouch for holding contents and more particularly, a standup pouch having two legs, each having a bottom gusset.

BACKGROUND OF THE INVENTION

It is known to provide stand up pouches for holding contents from flexible film. The film is typically a laminate formed from layers of flexible material. These pouches, known as doyen pouches, are formed by sealing the edges and mounting a bottom gusset between two panels of film. The gusset is sealed in such a manner that when the pouch is filled, material pushes the panels apart to form an ovate shaped bottom. The pouch has a generally triangular cross section from top to bottom. It is also known to curve the shape of the side edges. However for marketing purposes, it is desirable to provide distinctive shapes for particular products. Accordingly it is desirable to provide standard pouches which can be formed in a variety of shapes such as letters or numerals which can represent the contents inside the pouch.

SUMMARY OF THE INVENTION

A standup flexible pouch for holding contents is formed in a shape to represent an object such as a letter or numeral. The pouch has a lower portion including a pair of legs. Each leg has a gusset for supporting the pouch in an upright position. A bridge portion connects the legs. A pair of arms form an upper portion which extend above the bridge. The pouch has one opening mechanism such as tear off portion or a fitment. The opening mechanism is positioned at the top of an arm. Frangible seals can be used to form compartments for different types of contents. At least sixty percent of the weight of the contents must be below a horizontal center line of the pouch.

DETAILED DESCRIPTION OF THE PREFERRED EMBODIMENTS

Figure 1:
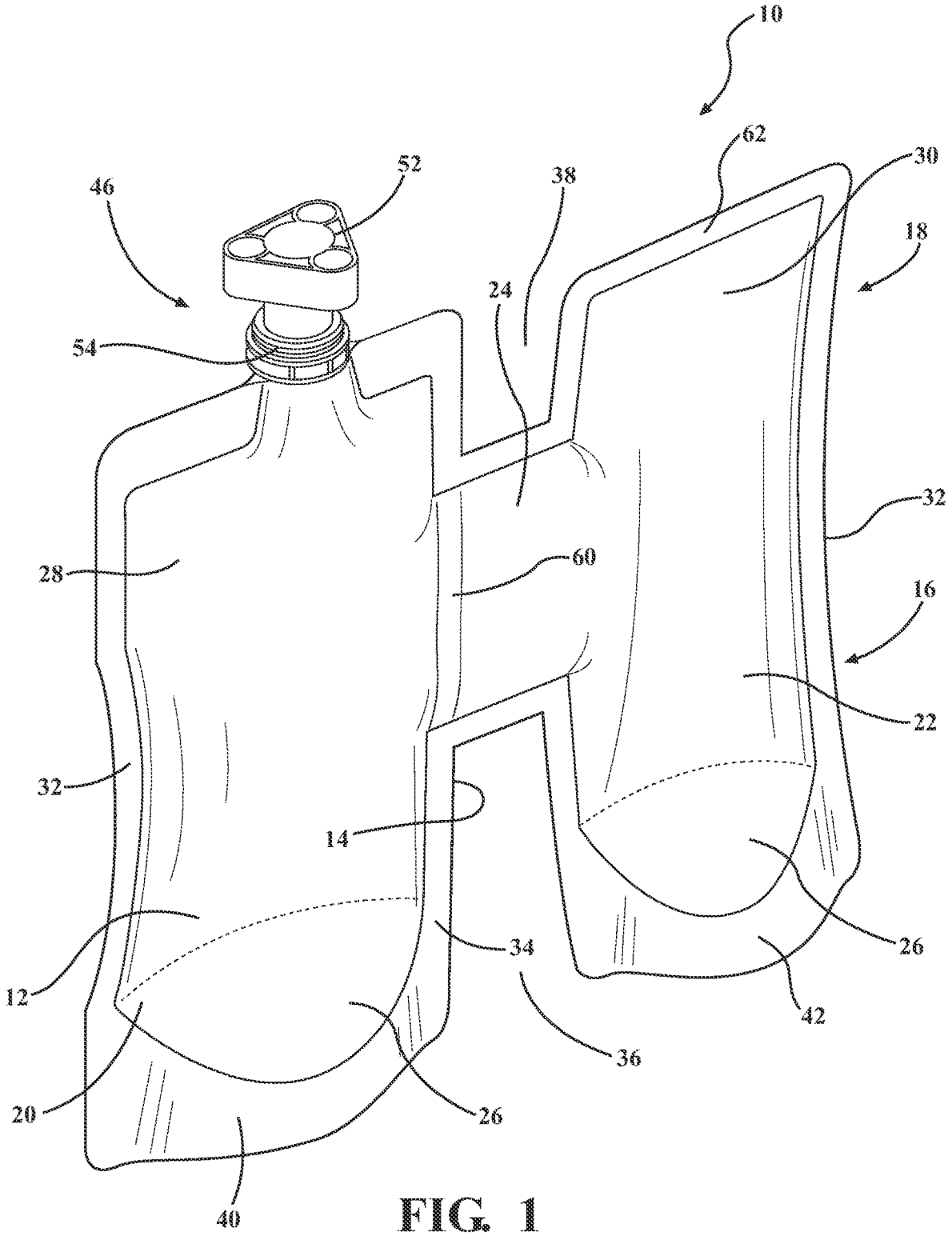
FIG. 1 is a perspective view of an object shaped pouch.

As shown in FIG. 1, a standup pouch 10 is formed in a shape to represent objects such as letters and numerals. The pouch is formed from a front panel 12 and rear panel 14 of a flexible film. The film is typically a laminate of layers of materials such as PET/LLDPE, aluminum, nylon, etc. The pouch and method of forming will be described to form the letter "H." however, many letters or numerals can be made according to this method.

Figure 2:
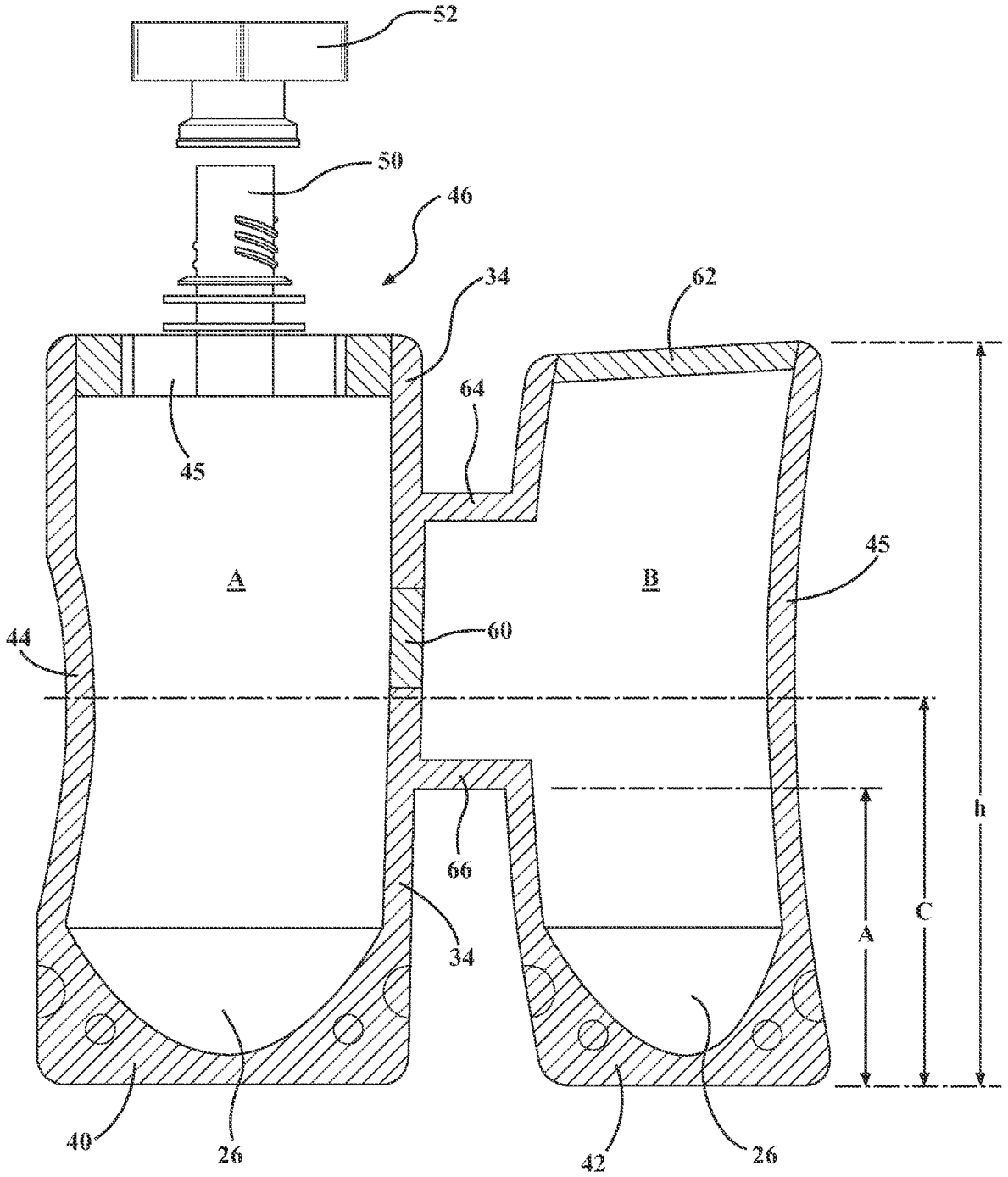
FIG. 2 is a cross-sectional view of the object shaped pouch of FIG. 1.

As shown in FIGS. 1 and 2, the flexible pouch includes a lower portion 16, an upper portion 18 and a bridge portion 24. The lower portion 16 has two leg portions 20, 22. The bridge portion 24 extends between the legs portions 20, 22. Each of the two leg portions 20, 22 has a gusset panel 26 so that the pouch can stand. The upper portion 18 has a pair of arms, 28, 30 each arm extending above a leg portion 20, 22.

The front panel 12 and back panel 14 which are sealed together along peripheral side edges 32 at least one forming compartments A and B for holding contents. Compartments A and B may be connected across the bridge portion 24 or separated by permanent of frangible seals as discussed below.

Cut-outs 36, 38 are formed in the panels by die cutters. The cut out 36 extends vertically from a bottom of the panels and cut out 38 extends downwardly from a top of the panels to form the bridge portion 24. The bridge portion 24 permits the pouches to be folded for transportation and storage. The bridge portion 24 can communicate contents between the two leg portions 20, 22.

The gusset panel 26 is sealed into a bottom of each leg portion, such that when the pouch is filled, the panels separate and the gusset panel forms a bottom of the pouch. A lower portion 40 of each leg portion 20, 22 forms a generally oval shape around the gusset panel 26 to support the pouch 10. It has been found that it is advantageous to form an arc or curve in the side edges 44 of one of the sides. The size of the gusset and the curves assist in controlling the volume of the compartments.

Figure 3:
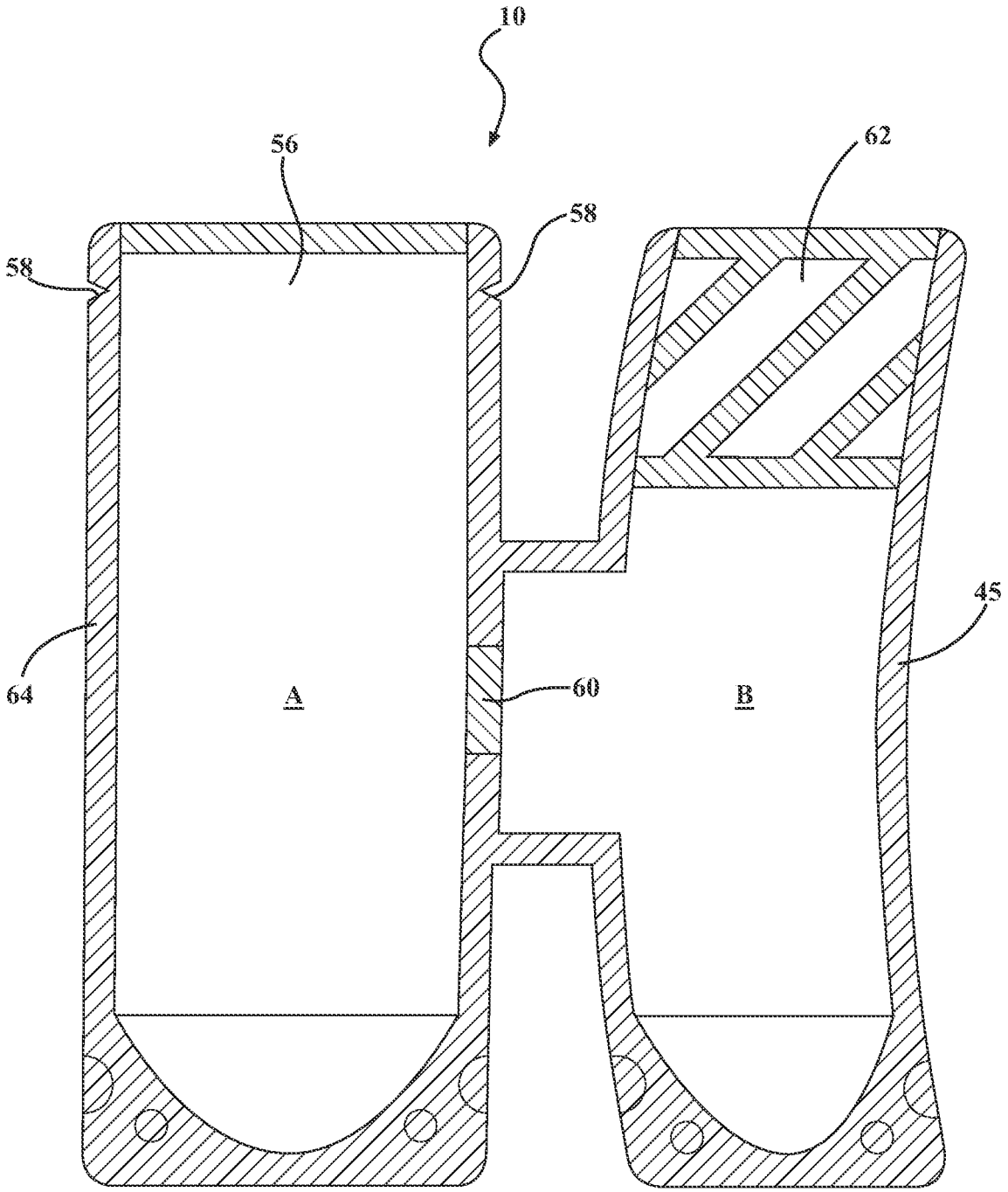
FIG. 3 is a cross-sectional view of the object shaped pouch with a tear off strip and a permanent seal.

As shown in FIG. 1, an opening mechanism such as a fitment 46 is mounted in a top of at least one of the arms 28. In some cases, each arm is provided with an opening mechanism. As shown in FIG. 2, the fitment 46 includes a canoe 48 which is sealed between the front panel 12 and rear panel 14. The fitment also includes a threaded spout 50. A cap 52 is threadably mounted to the spout 50 and has a tamper evident strip 54 that ruptures when the cap 50 is twisted. As shown in FIG. 3, the opening mechanism can be a tear strip 56 formed by a pair of notches 58 for facilitating removal of a top portion of the arm.

Figure 4:
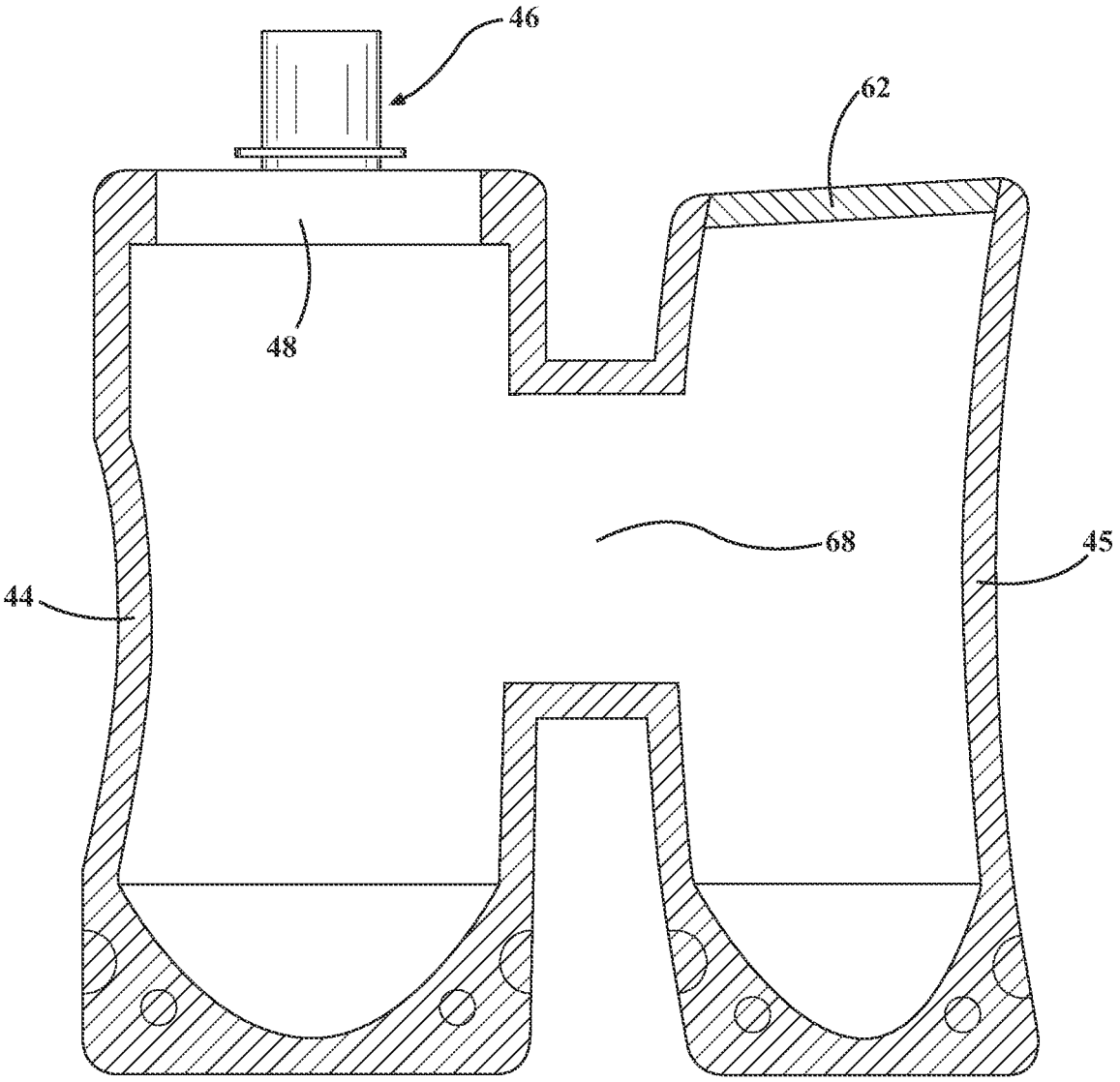
FIG. 4 is a cross-sectional view of the object shape with a open passageway through a bridge.

As shown in FIG. 2, a frangible seal 60 may extend across the bridge portion 24 to separate compartment A from compartment B. This permits a first component such as a liquid to be held in compartment A and a second component to be held in compartment B. At the time of use, the frangible seal 60 is burst by squeezing the pouch and the first and second components can then be mixed within the pouch 10. After mixing, the cap 52 is removed to provide access to the mixed contents. The first component is filled through the fitment and an open top of component B is filled into the second compartment and a permanent seal 62 is formed across the top of the second arm 30. As shown in FIG. 4, the pouch may be formed with no frangible seal so that the same material is filled in both the compartments.

As shown in FIG. 2, it is necessary to maintain a number of relationships in order to permit the pouch 10 to stand properly. At least 60% of the weight of the contents must be below a horizontal center line "c" of the pouch. The center line is one half of a total vertical height "h" of the volume of the pouches. Additionally, the center of the bridge must be at or above the center line "c" of the pouch and a height "o" of the lower cut out is preferably about 40% of the total height "h." The heights of the gusset, the width of the legs and the curve of the sides may be adjusted to allow for different volumes within the compartments A and B.

As discussed below, a variety of compartment arrangements can be formed using frangible or permanent seals. This permits various configurations for holding a variety of products.

As shown in FIG. 3, a permanent seal 62 can be formed on the top of compartment B, the height of the permanent seal 62 can be adjusted depending on the volume of the contents to filled into compartment B.

Figure 5:
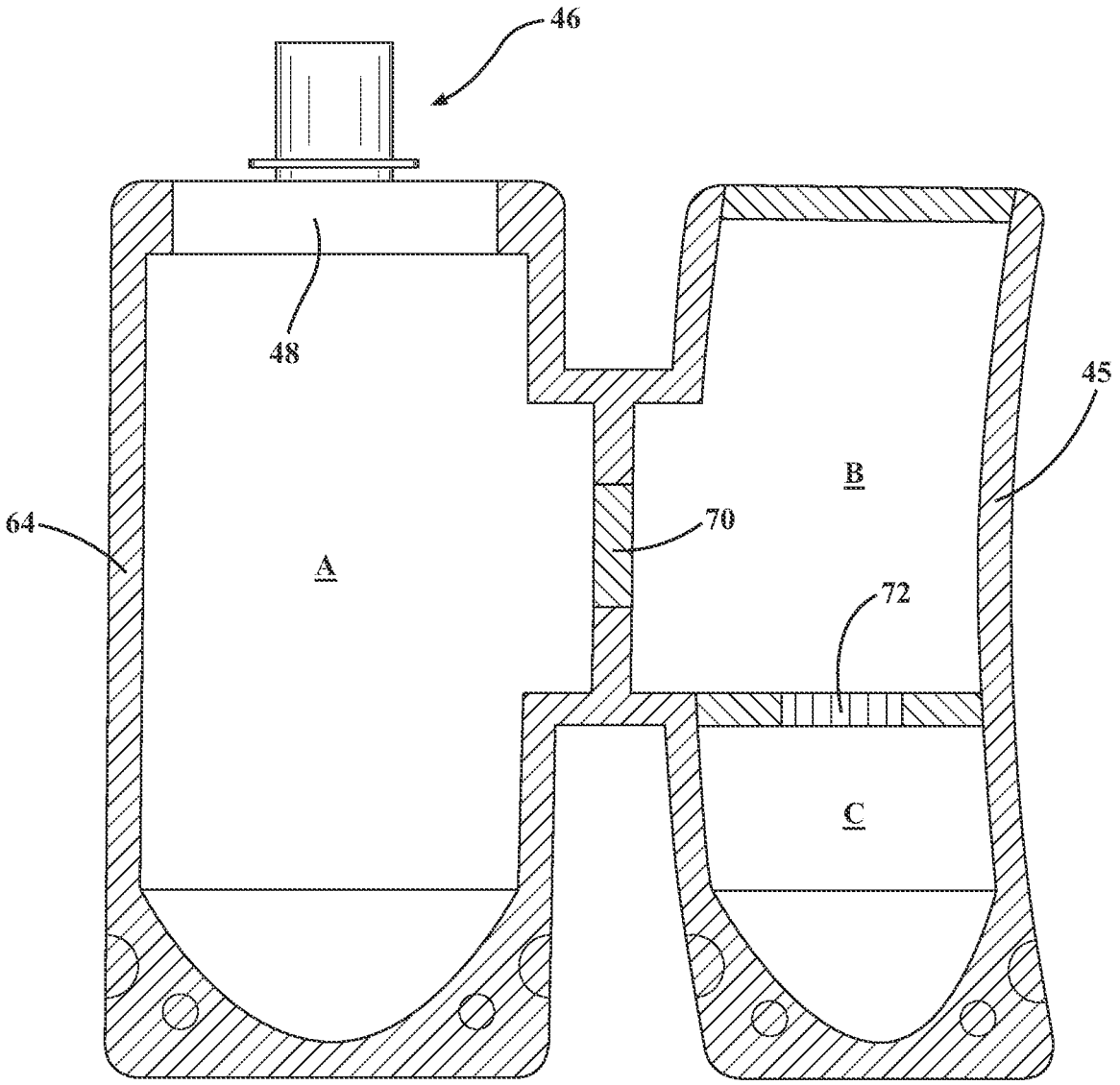
FIG. 5 is a cross-sectional view of an object shaped pouch with a fitment and frangible seals crossing one leg and the bridge.

As shown in FIG. 5, the pouch can have one or more straight side edges 64 and the frangible seal 60 can be located opening to the bridge on the side of compartment B. Compartment C is formed by a frangible seal which extends across the lower portion of one leg. A fitment 46 is provided on one arm 20.

Figure 7:
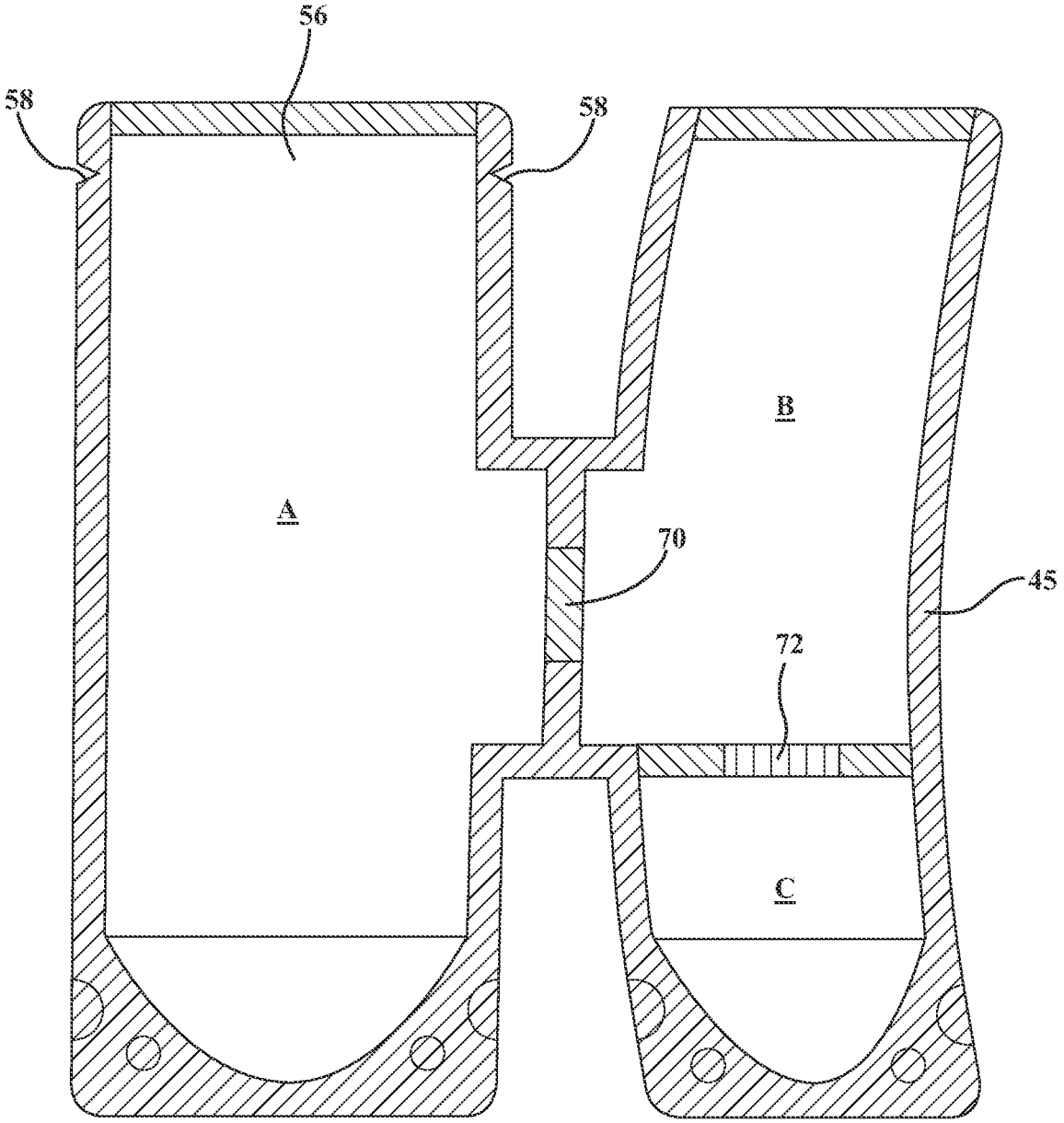
FIG. 7 is a cross-sectional view of a pouch having a tear strip and frangible seals crossing one leg and the bridge.

As shown in FIG. 7, a frangible seal can be formed across one of the legs and across the bridge. Notches 58 for a tear strip 56 are provided.

Figure 8:
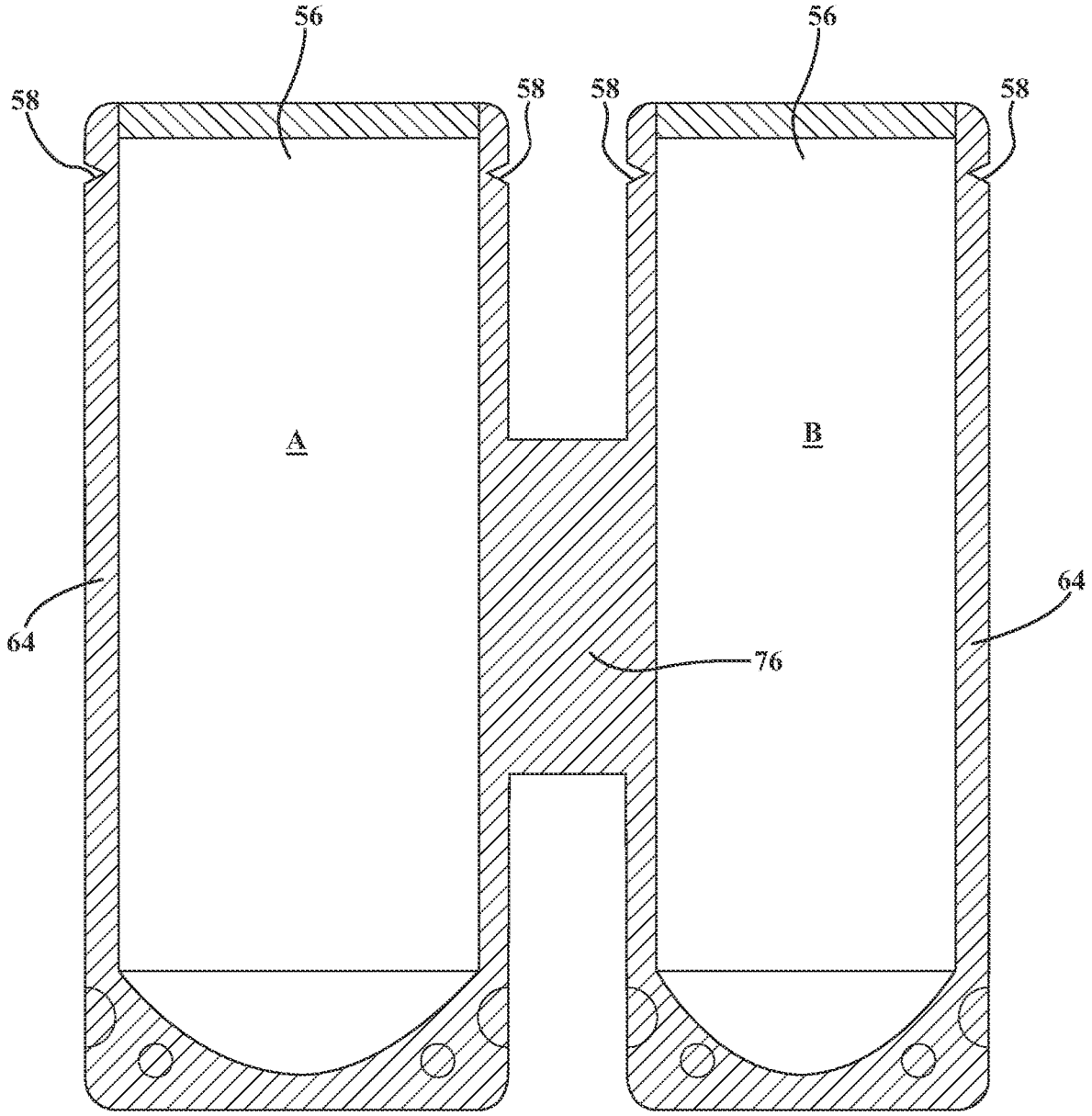
FIG. 8 is a cross-sectional view of a pouch having a sealed bridge.

As shown in FIG. 8, a permanent seal 76 may be formed in the bridge. This arrangement is useful when the compartments will be filled with different components that are not mixed. Separate tear notches 58 are provided on the tops of the arms.

Figure 6:
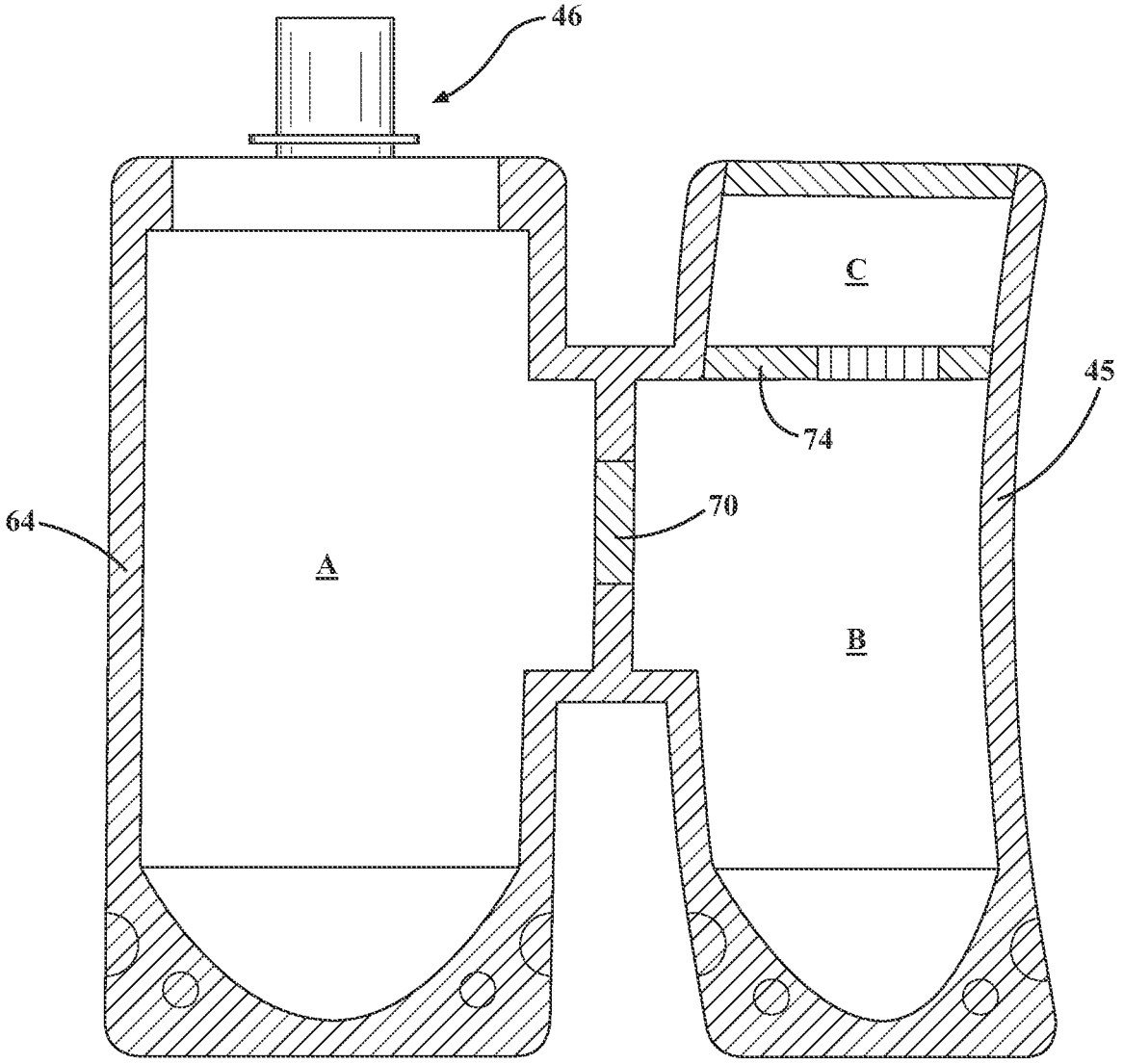
FIG. 6 is a cross-sectional view of an object shaped pouch with frangible seals across an arm and across the bridge.

FIG. 6 shows a frangible seal 74 cross the upper portion of the arm 22.

As shown in FIG. 7, a frangible seal can be formed across one of the legs 22. A frangible seal 70 can be formed across the bridge.

Other letters and objects can be formed for instance the letter "A", "K", "R" "W", and "X". For the letter "A", the two arms are angled together and connected at the top. For the letter "K", one arm extends at an angle from the bridge.

The invention claimed is:

1. A flexible pouch for holding contents, the pouch comprising:

a pair of leg portions each leg portion having a gusset for supporting the pouch on a bottom of each leg portion and having a compartment for holding the contents in an upright position bridge;

a bridge portion extending between the pair of leg portions; at least one arm extending above the bridge portion; and an opening device mounted in the at least one arm for accessing the contents; and a frangible seal extending across the bridge portion to separate the compartment of one leg portion from the compartment of the other leg portion of the pair of leg portions;

wherein rupture of the frangible seal provides a fluid passageway between the compartments of the pair of leg portions, where the at least one arm comprises a second arm extending above the bridge portion and wherein the second arm has a second seal formed at a top of the compartment of an associated leg portion of the pair of leg portions.

2. The flexible pouch of claim 1, wherein the frangible seal is disposed opening to the bridge portion on a side of the compartment of one of the leg portions.

3. The flexible pouch of claim 1, wherein the opening device is a fitment.

4. The flexible pouch of claim 1, wherein the opening device is a tear strip formed by a pair of notches.

5. The flexible pouch of claim 1, wherein the second frangible seal is formed across one of the leg portions.

6. The flexible pouch of claim 1, wherein the second seal is a frangible seal formed across the at least one arm.

7. The flexible pouch of claim 1, wherein the compartments of the pair of leg portions are each filled with the contents, and wherein the pouch includes a horizontal centerline wherein at least 60% of the weight of the contents disposed in the pouch is positioned below the center line.

8. The flexible pouch of claim 7, wherein a center of the bridge portion is at or above the center line.

9. A flexible pouch for holding contents, the pouch comprising:

a pair of leg portions each leg portion having a gusset for supporting the pouch on a bottom each leg portion and having a compartment for holding the contents in an upright position bridge, at least one of the leg portions including a concave arc formed in a side edge on a side of the at least one leg portion;

a bridge portion comprising a frangible seal extending between the pair of leg portions; and at least one arm extending above the bridge portion;

an opening device mounted in the at least one arm for accessing the contents, where the at least one arm comprises a second arm extending above the bridge portion and wherein the second arm has a seal formed at a top of the compartment of an associated leg portion of the pair of leg portions.

10. The flexible pouch of claim 9, wherein the frangible seal extending across the bridge portion to separate the compartment of one leg portion from the compartment of the other leg portion of the pair of leg portions, wherein rupture of the frangible seal provides a fluid passageway between the compartments of the pair of leg portions.

11. A flexible pouch for holding contents, the pouch comprising:

a front panel joined to a rear panel, the front and rear panels including an upper portion and a lower portion;

a pair of leg portions formed in the lower portion,. each leg portion having a gusset for supporting the pouch on a bottom of each leg portion and having a compartment for holding the contents in an upright position bridge;

a bridge portion extending between the pair of leg portions, the bridge portion defined by cutouts formed in the front and rear panels, a first cutout extending from a bottom of the front and rear panels and a second cutout extending from a top of the front and rear panels;

at least one arm formed in the upper portion and extending above the bridge portion;

an opening device mounted in the at least one arm for accessing the contents;

a frangible seal extending across the bridge portion to separate the compartment of one leg portion from the compartment of the other leg portion of the pair of leg portions; and wherein rupture of the frangible seal provides a fluid passageway between the compartments of the pair of leg portions, where the at least one arm comprises a second arm extending above the bridge portion and wherein the second arm has a second seal formed at a top of the compartment of an associated leg portion of the pair of leg portions.

12. The flexible pouch of claim 11, wherein a height of the first cutout is about 40% of a total height of the pouch.

13. The flexible pouch of claim 11, wherein the second seal is a frangible seal formed across the at least one arm.

14. The flexible pouch of claim 11, wherein the opening device comprises a fitment.

* * * * *